US010302354B2

(12) United States Patent
Shuntich

(10) Patent No.: US 10,302,354 B2
(45) Date of Patent: May 28, 2019

(54) PRECISION SUPERCOOLING REFRIGERATION DEVICE

(71) Applicant: Supercooler Technologies, Inc., Maitland, FL (US)

(72) Inventor: Douglas J. Shuntich, Maitland, FL (US)

(73) Assignee: Supercooler Technologies, Inc., Maitland, FL (US)

( * ) Notice: Subject to any disclaimer, the term of this patent is extended or adjusted under 35 U.S.C. 154(b) by 0 days.

(21) Appl. No.: 15/903,994

(22) Filed: Feb. 23, 2018

(65) Prior Publication Data

US 2018/0180353 A1 Jun. 28, 2018

Related U.S. Application Data

(63) Continuation-in-part of application No. 14/552,448, filed on Nov. 24, 2014, and a continuation-in-part of (Continued)

(51) Int. Cl.
*F25D 29/00* (2006.01)
*F25D 31/00* (2006.01)

(Continued)

(52) U.S. Cl.
CPC ..... *F25D 31/007* (2013.01); *F25C 5/22* (2018.01); *F25D 3/08* (2013.01); *F25D 17/06* (2013.01);

(Continued)

(58) Field of Classification Search
CPC .... F25D 16/00; F25D 17/06; F25D 2303/081; F25D 2317/0682; F25D 2400/28;

(Continued)

(56) References Cited

U.S. PATENT DOCUMENTS 136,632 A 3/1873 Whipple
714,415 A 11/1902 Trafford (Continued)

FOREIGN PATENT DOCUMENTS

GB 2391219 2/2004
JP 898675 4/1996

(Continued)

OTHER PUBLICATIONS

Shields, New Refrigeration Tech Cools Drink in 45 seconds, Food & Drink International, 2014, www.fdiforum.net, 3 pages.

(Continued)

*Primary Examiner* — Filip Zec
(74) *Attorney, Agent, or Firm* — Brian S. Steinberger; Law Offices of Brian S. Steinberger, P.A.

(57) ABSTRACT

A refrigerator capable of supercooling a target liquid, housing a slush activation, and a control method thereof are provided. The refrigerator includes a temperature sensor which senses a temperature of the refrigerator's interior volume or of the target liquid therein and the temperature sensor is programmed to send warnings, alerts and messages to a user or as a default, activate a controller that cycles the compressor off and on to increase the temperature within the area where the ice nucleation and freezing is detected. In addition to a user-interactive warning system, a location system for a closed liquid container that is beginning to freeze is based on the detection of heat energy resulting from the exothermic crystallization reaction of a liquid that is beginning to freeze. A method, system and device is provided to prevent the unwanted occurrence of frozen, ruptured containers of supercooled liquid in closed containers. A refrigerator can have an inside compartment for chilling beverage containers to super cooled temperatures. A front door exterior port(s) on the refrigerator can be used for (Continued)

activating the slush formation from the super cooled liquid contents in the beverage containers. The front door exterior port can also be used as well for rapid chilling beverage containers to selected chilled temperatures with or with slush activation of the liquid contents in the beverage containers.

20 Claims, 9 Drawing Sheets

Related U.S. Application Data application No. 14/526,436, filed on Oct. 28, 2014, now Pat. No. 9,989,300, and a continuation-in-part of application No. 14/731,850, filed on Jun. 5, 2015, now Pat. No. 10,149,487, which is a continuation-in-part of application No. 14/298,117, filed on Jun. 6, 2014, now Pat. No. 9,845,988, said application No. 15/903,994 is a continuation-in-part of application No. 15/790,269, filed on Oct. 23, 2017, which is a continuation of application No. 14/298,117, filed on Jun. 6, 2014, now Pat. No. 9,845,988.

(60) Provisional application No. 61/963,571, filed on Dec. 9, 2013, provisional application No. 61/961,905, filed on Oct. 28, 2013, provisional application No. 61/963,045, filed on Nov. 22, 2013, provisional application No. 62/176,031, filed on Feb. 9, 2015, provisional application No. 61/999,812, filed on Aug. 7, 2014, provisional application No. 61/966,106, filed on Feb. 18, 2014.

(51) Int. Cl.

| | |
|---|---|
| ***F25D 3/08*** | (2006.01) |
| ***F25D 17/06*** | (2006.01) |
| ***F25C 5/20*** | (2018.01) |
| *F25D 16/00* | (2006.01) |

(52) U.S. Cl.

CPC ..... *F25D 29/008* (2013.01); *F25D 31/006* (2013.01); *F25D 16/00* (2013.01); *F25D 31/002* (2013.01); *F25D 2303/081* (2013.01); *F25D 2317/0682* (2013.01); *F25D 2400/28* (2013.01); *F25D 2400/36* (2013.01); *F25D 2400/361* (2013.01); *F25D 2700/00* (2013.01); *F25D 2700/12* (2013.01); *F25D 2700/16* (2013.01)

(58) Field of Classification Search

CPC ..... F25D 2400/36; F25D 2400/361; F25D 2700/00; F25D 2700/12; F25D 2700/16; F25D 29/008; F25D 31/002; F25D 31/006; F25D 31/007; F25D 3/08

See application file for complete search history.

(56) References Cited

U.S. PATENT DOCUMENTS

| | | | | |
|---|---|---|---|---|
| 1,827,856 | A | | 10/1931 | Pope |
| 1,854,731 | A | | 4/1932 | Beran |
| 1,984,047 | A | | 12/1934 | Thieme |
| 2,061,427 | A | | 11/1936 | King |
| 2,073,176 | A | | 3/1937 | Quinn |
| 2,094,774 | A | | 10/1937 | Dawson |
| 2,289,645 | A | | 7/1942 | Geistert |
| 2,314,586 | A | | 3/1943 | Levison |
| 2,405,091 | A | | 7/1946 | Culbreth |
| 2,446,614 | A | | 8/1948 | Sherick |
| 2,629,229 | A | | 2/1953 | Hull |
| 2,736,174 | A | | 2/1956 | Tice |
| 2,764,489 | A | | 9/1956 | Veazey |
| 2,923,786 | A | * | 2/1960 | Jones ..... F25D 29/005 200/56 R |
| 2,990,624 | A | | 7/1961 | Granath |
| 3,065,553 | A | | 11/1962 | Olin |
| D198,488 | S | | 6/1964 | Reis |
| 3,284,991 | A | | 11/1966 | Ploeger |
| 3,401,858 | A | | 9/1968 | White |
| 3,434,410 | A | | 3/1969 | Galle |
| 3,453,083 | A | | 7/1969 | Beerli |
| 3,718,485 | A | | 2/1973 | Lankford |
| 3,813,928 | A | | 6/1974 | Anderson |
| 3,860,166 | A | | 1/1975 | Anderson |
| 3,915,285 | A | | 10/1975 | Lindquist |
| 3,987,211 | A | | 10/1976 | Dunn |
| 4,023,947 | A | | 5/1977 | Ferry |
| 4,132,186 | A | | 1/1979 | Manske |
| 4,142,372 | A | | 3/1979 | Kato et al. |
| 4,164,851 | A | | 8/1979 | Bryant |
| 4,172,365 | A | | 10/1979 | McClintock |
| 4,358,932 | A | | 11/1982 | Helfrich, Jr. |
| 4,358,934 | A | | 11/1982 | Vankirk |
| 4,457,214 | A | * | 7/1984 | deVries ..... E04H 5/10 454/255 |
| 4,493,156 | A | | 1/1985 | Siegmann |
| 4,549,409 | A | | 10/1985 | Smith |
| 4,580,405 | A | | 4/1986 | Cretzmeyer, III |
| D293,758 | S | | 1/1988 | Balisteri |
| 4,736,600 | A | | 4/1988 | Brown |
| 4,785,959 | A | | 11/1988 | Kleiner |
| 4,825,665 | A | | 5/1989 | Micallef |
| 4,961,322 | A | | 10/1990 | Oguma et al. |
| 4,979,994 | A | | 12/1990 | Dussault |
| 5,144,816 | A | | 9/1992 | Chase |
| 5,240,177 | A | | 8/1993 | Muramatsu et al. |
| 5,269,156 | A | | 12/1993 | Van De Velde |
| 5,282,368 | A | | 2/1994 | Ordoukhanian |
| 5,388,427 | A | | 2/1995 | Lee |
| 5,477,623 | A | | 12/1995 | Tomizawa |
| 5,505,054 | A | | 4/1996 | Loibl |
| 5,653,123 | A | | 8/1997 | Handlin |
| 5,695,795 | A | | 12/1997 | Murray |
| D392,514 | S | | 3/1998 | Steinfels |
| 5,880,359 | A | | 3/1999 | Kono et al. |
| 5,939,120 | A | | 8/1999 | Bogue |
| 5,964,101 | A | | 10/1999 | Schulak et al. |
| 5,966,964 | A | | 10/1999 | Pattee |
| 6,116,042 | A | | 9/2000 | Purdum |
| 6,146,600 | A | | 11/2000 | Williamson |
| 6,253,559 | B1 | | 7/2001 | Kinkel et al. |
| 6,272,867 | B1 | | 8/2001 | Barrash et al. |
| D449,763 | S | | 10/2001 | Harris, Jr. |
| 6,314,751 | B1 | | 11/2001 | Gjersvik |
| D455,607 | S | | 4/2002 | Johnson |
| 6,408,634 | B1 | | 6/2002 | Choi |
| 6,413,444 | B1 | | 7/2002 | Kasza |
| 6,543,154 | B2 | | 4/2003 | Horigane |
| 6,662,574 | B2 | | 12/2003 | Loibl |
| 6,691,530 | B2 | | 2/2004 | Lee |
| 6,730,341 | B2 | | 5/2004 | Ludwig |
| 6,904,761 | B2 | | 6/2005 | Rafalovich et al. |
| D508,719 | S | | 8/2005 | De Hass |
| 6,945,069 | B2 | | 9/2005 | Lee |
| 7,032,408 | B2 | | 4/2006 | Dentella et al. |
| D540,126 | S | | 4/2007 | Leahy |
| D552,417 | S | | 10/2007 | Ben-Shlomo et al. |
| 7,296,422 | B2 | | 11/2007 | Strohm et al. |
| D569,692 | S | | 5/2008 | Zell |
| D574,128 | S | | 8/2008 | Meiry |
| 7,520,212 | B2 | | 4/2009 | Smith |
| D614,442 | S | | 4/2010 | Smith |
| 7,703,295 | B2 | | 4/2010 | Zangari et al. |
| 7,707,848 | B2 | | 5/2010 | Loibl |
| 7,712,321 | B2 | | 5/2010 | Kadyk |
| 7,874,167 | B2 | | 1/2011 | Kammer |
| 7,934,384 | B2 | | 5/2011 | Tuskiewicz et al. |
| 7,997,094 | B2 | | 8/2011 | Zangari et al. |
| D655,122 | S | | 3/2012 | Bingul et al. |

(56) References Cited

U.S. PATENT DOCUMENTS

| | | | | |
|---|---|---|---|---|
| 8,132,960 | B2 | 3/2012 | Zhuang | |
| 8,225,620 | B2 | 7/2012 | Prentner | |
| 8,434,317 | B2 | 5/2013 | Besore | |
| 8,464,544 | B2 | 6/2013 | Shin et al. | |
| 8,534,085 | B2 | 9/2013 | Zangari et al. | |
| 8,549,993 | B2 | 10/2013 | Foster | |
| 8,572,990 | B2 | 11/2013 | Chung et al. | |
| D705,607 | S | 5/2014 | Zorovich et al. | |
| D707,497 | S | 6/2014 | Tello | |
| 9,024,168 | B2 | 5/2015 | Peterson | |
| 9,134,059 | B2 | 9/2015 | Chung et al. | |
| 9,234,697 | B2 | 1/2016 | Youn et al. | |
| D749,913 | S | 2/2016 | Feng | |
| D778,687 | S | 2/2017 | Shuntich | |
| 9,631,856 | B2 | 4/2017 | Shuntich | |
| 9,841,224 | B2 | 12/2017 | Hitzelberger et al. | |
| 9,845,988 | B2 | 12/2017 | Shuntich | |
| 9,989,300 | B1 | 6/2018 | Shuntich | |
| 2002/0124576 | A1 | 9/2002 | Loibl | |
| 2003/0090890 | A1 | 5/2003 | Miozza et al. | |
| 2003/0192435 | A1 | 10/2003 | McNair | |
| 2004/0103552 | A1 | 6/2004 | Rhon | |
| 2004/0112413 | A1 | 6/2004 | Brunner | |
| 2004/0144103 | A1 | 7/2004 | Lee et al. | |
| 2004/0187503 | A1* | 9/2004 | Davis | F25D 17/065 62/180 |
| 2004/0237544 | A1 | 12/2004 | Ueno et al. | |
| 2005/0142268 | A1 | 6/2005 | Scullion | |
| 2005/0166768 | A1 | 8/2005 | Porat | |
| 2005/0217282 | A1 | 10/2005 | Strohm et al. | |
| 2006/0185372 | A1 | 8/2006 | Conde Hinojosa | |
| 2006/0191086 | A1 | 8/2006 | Mourad | |
| 2006/0225439 | A1 | 10/2006 | Morris, III | |
| 2006/0248904 | A1 | 11/2006 | Ludwig | |
| 2006/0260345 | A1 | 11/2006 | Coulter et al. | |
| 2007/0057388 | A1 | 3/2007 | McCabe | |
| 2007/0137223 | A1 | 6/2007 | Brekke | |
| 2007/0163289 | A1 | 7/2007 | Hahm et al. | |
| 2007/0204629 | A1 | 9/2007 | Lofy | |
| 2008/0016886 | A1 | 1/2008 | Slate et al. | |
| 2008/0134695 | A1 | 6/2008 | Loibl | |
| 2008/0141701 | A1 | 6/2008 | Lewis | |
| 2008/0196443 | A1 | 8/2008 | Footer | |
| 2008/0302114 | A1 | 12/2008 | Kelly et al. | |
| 2009/0314012 | A1 | 12/2009 | Lim et al. | |
| 2010/0008178 | A1 | 1/2010 | Fahrion | |
| 2010/0058776 | A1 | 3/2010 | Loibl | |
| 2010/0062120 | A1 | 3/2010 | Jang et al. | |
| 2010/0133290 | A1 | 6/2010 | Luntz et al. | |
| 2010/0154452 | A1 | 6/2010 | McCann | |
| 2010/0162747 | A1 | 7/2010 | Hamel et al. | |
| 2010/0205986 | A1 | 8/2010 | Chung et al. | |
| 2010/0218510 | A1 | 9/2010 | Kim et al. | |
| 2010/0218542 | A1 | 9/2010 | McCollough et al. | |
| 2010/0293970 | A1 | 11/2010 | Mooijer | |
| 2011/0219805 | A1 | 9/2011 | Youn et al. | |
| 2011/0302940 | A1* | 12/2011 | Youn | F25D 17/062 62/129 |
| 2011/0308264 | A1 | 12/2011 | Youn | |
| 2012/0047922 | A1 | 3/2012 | Lee et al. | |
| 2012/0106130 | A1 | 5/2012 | Beaudette | |
| 2012/0137720 | A1 | 6/2012 | Ueda et al. | |
| 2012/0266619 | A1 | 10/2012 | Shaw | |
| 2013/0015753 | A1 | 1/2013 | Son et al. | |
| 2013/0055744 | A1 | 3/2013 | Travers | |
| 2013/0160987 | A1 | 6/2013 | Grigorian | |
| 2013/0167582 | A1* | 7/2013 | Jones | F25B 41/067 62/515 |
| 2013/0171920 | A1 | 7/2013 | Bhattacharya | |
| 2013/0180280 | A1 | 7/2013 | Grigorian | |
| 2013/0196044 | A1 | 8/2013 | Winston et al. | |
| 2013/0205809 | A1 | 8/2013 | Beni et al. | |
| 2013/0241386 | A1 | 9/2013 | Kim et al. | |
| 2013/0255304 | A1 | 10/2013 | Cur et al. | |
| 2013/0305752 | A1 | 11/2013 | Martin | |
| 2014/0125577 | A1 | 5/2014 | Hoang | |
| 2014/0216096 | A1 | 8/2014 | Leclear et al. | |
| 2014/0346942 | A1 | 11/2014 | Kim et al. | |
| 2014/0373567 | A1 | 12/2014 | Otsuki et al. | |
| 2014/0375198 | A1 | 12/2014 | Jeon et al. | |
| 2015/0059398 | A1 | 3/2015 | Yoo et al. | |
| 2015/0102717 | A1 | 4/2015 | Furr et al. | |
| 2015/0112451 | A1 | 4/2015 | Dechev | |
| 2015/0128483 | A1 | 5/2015 | Krupp et al. | |
| 2016/0131421 | A1 | 5/2016 | Bogaard | |
| 2016/0209098 | A1 | 7/2016 | Kim | |
| 2017/0353327 | A1 | 12/2017 | Doberstein et al. | |

FOREIGN PATENT DOCUMENTS

| | | | | |
|---|---|---|---|---|
| JP | 2005318869 | | 11/2005 | |
| JP | 2006300411 | | 11/2006 | |
| JP | 2012153614 | | 11/2012 | |
| JP | WO2012153614 | * | 11/2012 | F25D 11/00 |
| KR | 1020080088944 | | 10/2008 | |
| KR | 1020100018887 | | 2/2010 | |
| WO | 0049347 | | 8/2000 | |
| WO | 2010042662 | | 4/2010 | |

OTHER PUBLICATIONS

Ultrasonic Degassing and Defoaming of Liquids, Hielscher—Ultrasound Technology, 2015, 4 pages.

Shuntich, D.J., PCT Serial No. PCT/US14/47214, International Search Report and Written Opinion, dated Nov. 20, 2014, 18 pages.

Shuntich, Supercooler Technologies, Inc., PCT Application No. PCT/US2015/034418 filed Jun. 5, 2005, Notification of Transmittal of the International Search Report and the Written Opinion of the International Searching Authority, or the Declaration dated Sep. 14, 2015, 15 pages.

Shuntich, D.J., PCT Serial No. PCT/US14/47214, filed Jun. 18, 2014, Notification Concerning Transmittal of the International Preliminary Report on Patent Ability (Chapter 1 of the Patent Cooperation Treaty) (PCT Rule 44bis.1 (c)), dated Aug. 4, 2016, 7 pages.

Shuntich, D.J., PCT Serial No. PCT/US2015/034418, filed Jun. 5, 2015, Notification Concerning Transmittal of International Preliminary Report on Patentability (Chapter I of the Patent Cooperation Treaty) (PCT Rule 44bis.1copyright), dated Dec. 15, 2016, 11 pages.

Shuntich, D.J., PCT Serial No. PCT/US2014047214, filed Aug. 19, 2016, the partial supplementary European search report, dated Aug. 18, 2017, 15 pages.

Supercooler Technologies, Inc., European Serial No. 15803479.3 filed Mar. 17, 2017, European Supplementary Search Report dated Apr. 4, 2017, 7 pages.

Shuntich, Utility U.S. Appl. No. 14/552,448 filed Nov. 24, 2014, Office Action Summary dated Feb. 8, 2018, 46 pages.

Shuntich, Utility U.S. Appl. No. 14/564,330 filed Dec. 9, 2014, Office Action Summary dated Apr. 13, 2018, 33 pages.

* cited by examiner

FIG. 1
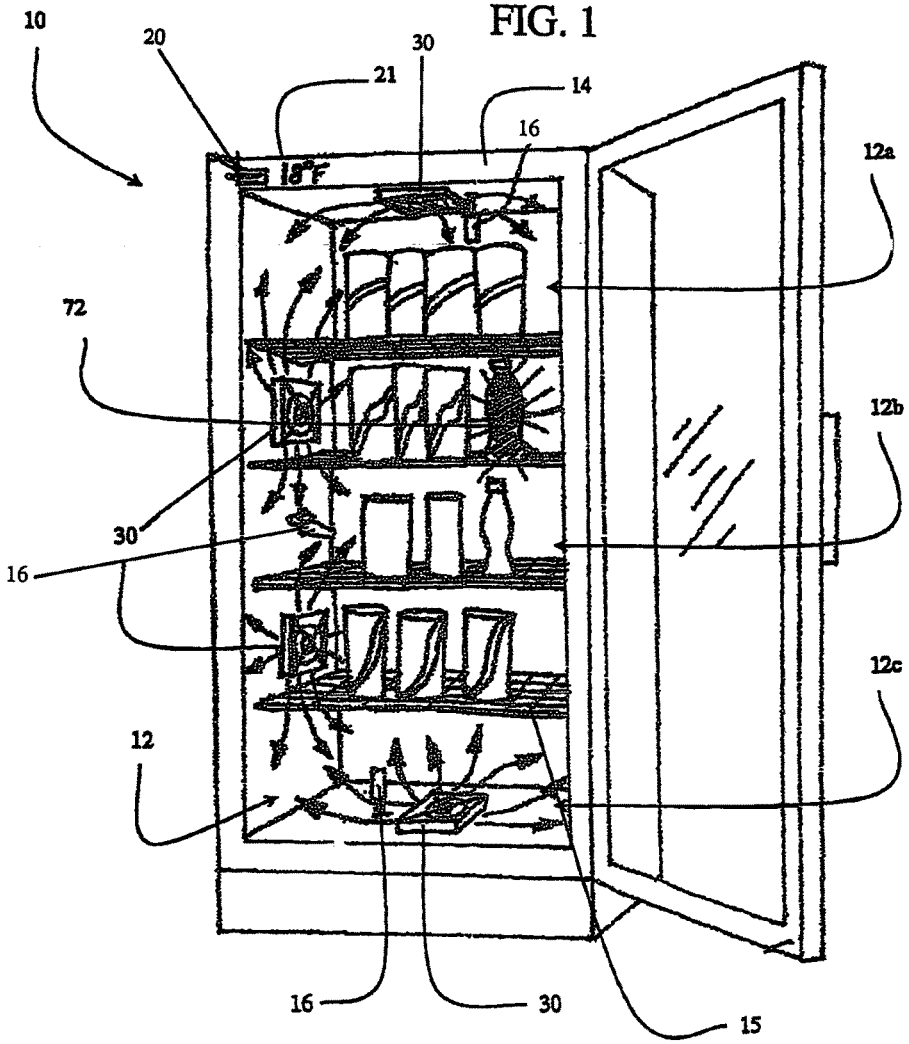
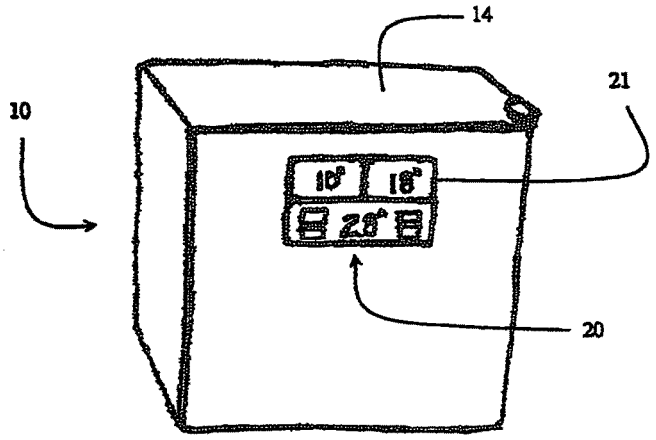
FIG. 1A

PRECISION SUPERCOOLING REFRIGERATION DEVICE

CROSS REFERENCE TO RELATED APPLICATIONS

This application is a Continuation-In-Part of U.S. patent application Ser. No. 14/552,448 filed Nov. 24, 2014, which claims the benefit of priority to U.S. Provisional Patent Application No. 61/963,571 filed Dec. 9, 2013, and this application is also a Continuation-in-part of U.S. patent application Ser. No. 14/526,436, filed on Oct. 28, 2014, which claims the benefit of priority of U.S. Provisional Patent Application 61/961,905 filed Oct. 28, 2013, U.S. Provisional Patent Application No. 61/963,045 filed Nov. 22, 2013 and U.S. Provisional Patent Application No. 61/963,571 filed Dec. 9, 2013, and this application is a Continuation-In-Part of U.S. patent application Ser. No. 14/731,850 filed Jun. 5, 2015, which claims the benefit of priority to U.S. Provisional Application No. 62/176,031 filed Feb. 9, 2015 and U.S. Provisional Application 61/999,812 filed Aug. 7, 2014, and U.S. patent application Ser. No. 14/731,850 is a Continuation-In-Part of U.S. patent application Ser. No. 14/298,117 filed Jun. 6, 2014, now U.S. Pat. No. 9,845,988, which claims the benefit of priority to U.S. Provisional Patent Application No. 61/966,106 filed Feb. 18, 2014, and this application is a Continuation-In-Part of U.S. patent application Ser. No. 15/790,269 filed Oct. 23, 2017, which is a Continuation of U.S. patent application Ser. No. 14/298,117 filed Jun. 6, 2014, now U.S. Pat. No. 9,845,988, which claims the benefit of priority to U.S. Provisional Patent Application No. 61/966,106 filed Feb. 18, 2014. The entire disclosure of each of the applications listed in this paragraph are incorporated herein by specific reference thereto.

FIELD OF THE INVENTION

The present invention relates generally to supercooling, and in particular to, systems, devices and methods of supercooling, including the supercooling of liquids in closed containers to below approximately 32° F. (0° C.) and to identify and locate those containers before they freeze.

BACKGROUND OF THE INVENTION

Supercooling is the process of lowering the temperature of a liquid or a gas below its freezing point without it becoming a solid. A liquid crossing its standard freezing point will crystallize in the presence of a seed crystal or nucleus around which a crystal structure can form creating a solid.

Freezing is almost always an exothermic process, meaning that as liquid changes into solid, heat and pressure are released. This is often seen as counter-intuitive since the temperature of the material does not rise during freezing, except if the liquid were supercooled. But this can be understood, since heat must be continually removed from the freezing liquid or the freezing process will stop. The energy released upon freezing is a latent heat, and is known as the enthalpy of fusion and is exactly the same as the energy required to melt the same amount of the solid.

Lacking any such nuclei, the liquid phase can be maintained all the way down to the temperature at which crystal homogeneous nucleation occurs. Homogeneous nucleation can occur above the glass transition temperature, but if homogeneous nucleation has not occurred above that temperature an amorphous (non-crystalline) solid will form.

Water normally freezes at 273.15 K (0° C. or 32° F.) but it can be "supercooled" at standard atmospheric pressure (15 psi) down to its crystal homogeneous nucleation at almost 224.8 K (−48.3° C./−55° F.). The process of supercooling requires that water be pure and free of nucleation sites, which can be achieved by processes like reverse osmosis, but the cooling itself does not require any specialised technique.

The melting of a solid above the freezing point, which is the opposite of supercooling, is much more difficult, and a solid will almost always melt at the same temperature for a given pressure. For this reason, it is the melting point which is usually identified, using a melting point apparatus; even when the subject of a paper is "freezing-point determination", the actual methodology is "the principle of observing the disappearance rather than the formation of ice".

Supercooling is often confused with freezing-point depression. Supercooling is the cooling of a liquid below its freezing point without it becoming solid. Freezing point depression is when a solution can be cooled below the freezing point of the corresponding pure liquid due to the presence of the solute; an example of this is the freezing point depression that occurs when sodium chloride is added to pure water.

Refrigerated glass-door beverage merchandisers have been used for many years to keep beverages chilled below room temperature yet above the freezing point of water (32 deg-F, 0 deg-C). In recent years, several beverage merchandiser manufacturers have introduced special refrigerated merchandisers (super-chillers) for beer and other alcoholic beverages that chill these items below the freezing point of water, with advertised chilling temperatures as low as 22-28 deg-F (−5.5 to −2 deg-C). Manufacturers claim these lower storage temperatures are possible due to the alcohol content of these beverages which lowers their freezing point (freezing point depression). These sub 32 deg-F storage temperatures are generally considered beneficial for beers and alcoholic beverages since the flavor is colder and the beverage stays colder longer during consumption than when stored above 32 deg-F. However, these new alcoholic beverage merchandisers generally do not allow storage temperatures below 22 deg-F (−5 deg-C) since the freezing point of most beer is between 24-28 deg-F depending on specific alcohol content. Thus the current temperature ranges generally available for commercial beverage merchandisers are between 22 deg-F and 50 deg-F (−5.5 to +10 deg-C).

One commercial application of supercooling is in refrigeration. For example, there are freezers that cool drinks to a supercooled level so that when they are opened, they form a slush. The SLUSH-IT!™ drinks mixer system uses stickers placed on the beverage which is then placed into a specially designed receptacle. The receptacle is then placed in a standard freezer. Another example is a product that can supercool the beverage in a conventional freezer. The Coca-Cola Company also briefly marketed special vending machines containing Sprite in the UK, and Coke in Singapore, which stored the bottles in a supercooled state so that their content would turn to slush upon opening. This system, however, requires the use of a specially designed bottle.

Thus, it has been known that non-alcoholic bottled and canned beverages of all varieties, including bottled water, can be supercooled below 32 deg-F (0° C.) while remaining liquid for short periods of time regardless of the various types of ingredients. What is not generally known is how to store these beverages indefinitely in a supercooled liquid state without allowing them to freeze solid.

When supercooling beverages, the liquid beverage is sensitive to temperatures even a few degrees below the set point which is a temperature within a range below the freezing point of the liquid and above the solid phase transition temperature. The sensitivity of a supercooled liquid beverage to temperatures below the set point can cause the liquid to nucleate inadvertently and begin to freeze.

A prior art reference, Chung et al., U.S. Pat. No. 8,572,990, discloses an apparatus for supercooling which stably maintains a liquid in a supercooled state below a phase transition temperature by mounting temperature sensors directly to tops of each container (i.e., such as a bottle) and applying energy to the surface of the liquid or contents or to a gas near the surface while the liquid is maintained in the supercooled environment.

The prior art references do not acknowledge and address one specific problem that occurs in the supercooling of liquids which is the fact that liquids held below a freezing point can and do inadvertently begin ice nucleation and freezing. The nucleation can have a domino effect meaning that several closed containers will begin to freeze.

Since a frozen can or bottle is undesirable in a supercooler; there is a need for a user-interactive method or system to obviate this condition and prevent inadvertent nucleation of supercooled liquids as provided by the present invention without mounting sensors directly to tops of the containers.

The present invention also contemplates a standard refrigerator that is customized to contain a supercooler unit or compartment and a slush activation device. The supercooler unit or compartment includes a user-interactive method or system of the present invention to warn and alert a user thus alleviating concerns for the inadvertent freezing of supercooled liquids stored in closed containers inside the refrigerator. The slush activation device is located in the front door of the refrigerator to safely and conveniently create a slush, icy beverage or drink in the home environment.

SUMMARY OF INVENTION

One objective of the present invention is to provide a system, method or device for alerting a user that a bottle or closed container designated as a warning container is beginning to freeze in a supercooler unit.

A second objective of the present invention is to provide a system, method or device for locating at least one bottle or closed container within a supercooler unit that is beginning to freeze, and sending an alert to a user together with the location of the bottle or closed container that is beginning to freeze.

A third objective of the present invention is to provide a default, back-up system, method or device that operates in conjunction with the alert to the user for activating a programmable temperature sensor within a supercooler unit to send a signal to a user and the system's controller to raise the temperature in the supercooler unit above the freezing temperature of the supercooled liquid stored in the closed containers or take the necessary action to interrupt the inadvertent nucleation (slush activation) of supercooled liquids.

A fourth objective of the present invention is to provide a convenient, safe and efficient arrangement of a supercooler and slush activation device for use in a home environment.

The supercooler unit can be included in a refrigerator unit. The supercooler unit has an interior volume defining a refrigerating compartment configured to maintain a liquid in a supercooled state. The interior volume is defined by a plurality of interior walls. A door is attached to the unit to cover the interior volume when the door is in a closed position.

The invention includes a refrigeration device which provides rapid, uniform, precision beverage cooling in the necessary range of approximately 15 deg-F (−9.5° C.) to approximately 22 deg-F (−5.5° C.). This temperature range allows for a wide variety of non-alcoholic (and alcoholic) bottled and canned beverages to remain in a supercooled state within the interior volume. The refrigeration device includes the placement of evaporator coils to evenly distribute cooling along surface areas on the sides, back, top and bottom walls of the interior space of the refrigeration device to provide uniform cooling. Uniform cooling throughout the interior refrigerated space is used to prevent premature nucleation (freezing) of the supercooled beverages.

Electric fans placed on the sides, back, top and bottom interior walls direct air-flow to provide rapid, uniform, precision cooling throughout the interior refrigerated space. An electronic precision temperature controller using one or more strategically placed temperature probes inside the refrigerated space controls the on/off cycling of the compressor and/or the variable speed of the compressor to ensure maximum efficiency while maintaining the precise temperature set by the user.

Further objects and advantages of this invention will be apparent from the following detailed description of the presently preferred embodiments which are illustrated schematically in the accompanying drawings.

BRIEF DESCRIPTION OF THE DRAWINGS

The drawing figures depict one or more implementations in accord with the present concepts, by way of example only, not by way of limitations. In the figures, like reference numerals refer to the same or similar elements. For a fuller understanding of the invention, reference should be made to the following detailed description, taken in connection with the accompanying drawings, in which:

FIG. 1 is a perspective view of the illustrative supercooling system;

FIG. 1A is a front perspective view of the Controller of the supercooling operation;

DETAILED DESCRIPTION OF THE PREFERRED EMBODIMENT

Figure 2:
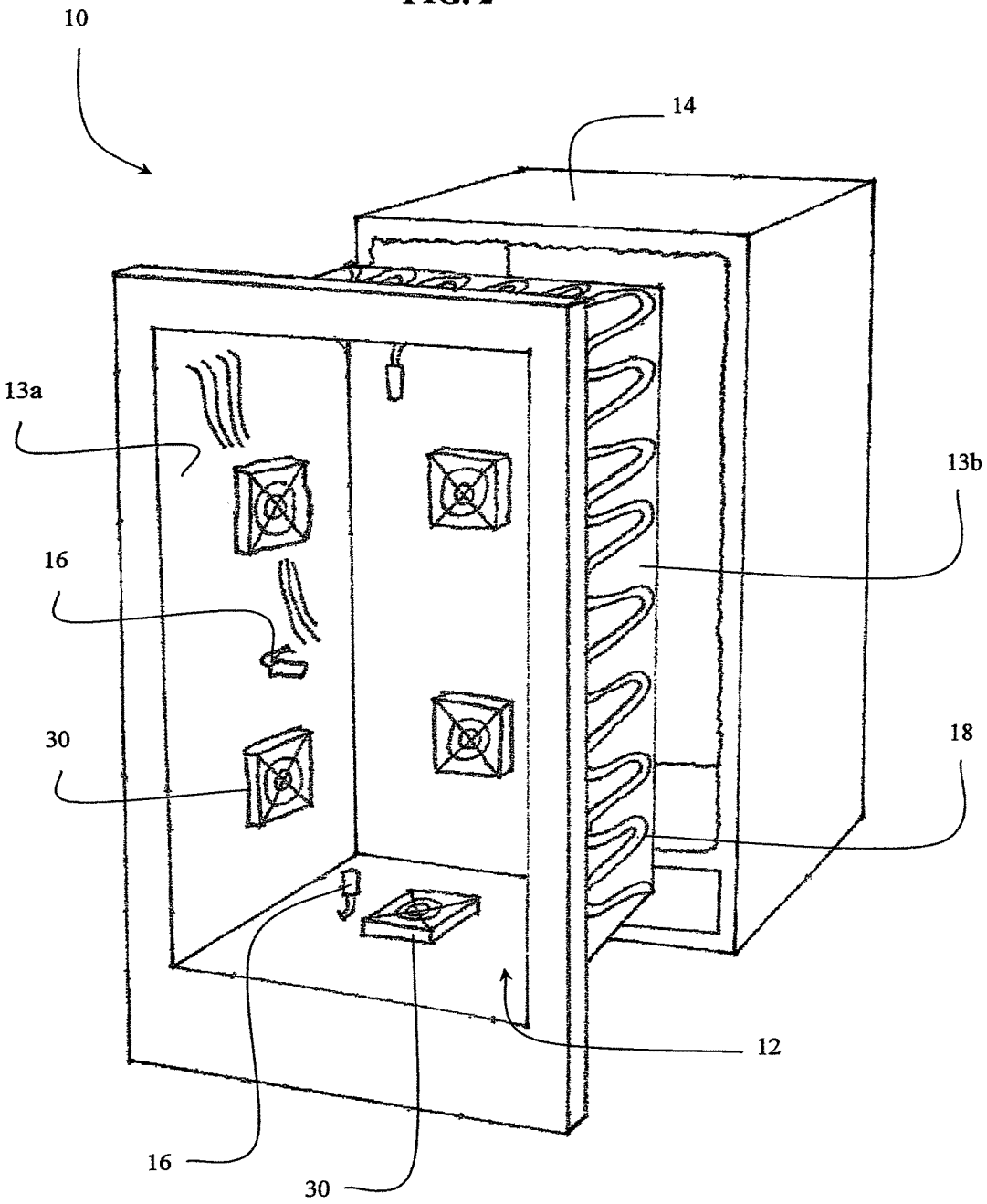
FIG. 2 is a partially exploded front view of the illustrative supercooling system.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

The following terms and acronyms used in the Detailed Description are defined below.

The term "approximately" can be +/−10% of the amount referenced. Additionally, preferred amounts and ranges can include the amounts and ranges referenced without the prefix of being approximately.

The term "alert" is used interchangeably with "warning" to include audible, visual, voice, lights, email message or text message directed to a human or robotic user or interface.

The phrase, "closed container" refers to bottles, cans, cardboard containers, foil bags, aseptic packaging and the like with a releasable closure for user access to the contents that can include beverages, liquids, sauces, soups, gravies and other pourable foodstuffs. The term "liquids" will be used herein to indicate all such foodstuffs to be stored in the closed container to abbreviate this disclosure.

The phrase, "programmable temperature sensor(s)" is used herein to describe temperature sensors that are customized with microprocessors to sense temperatures, compare temperatures in an algorithm to find the outlier, send signals, alerts or warnings to a user, to a user interface or to the controller of the supercooler system to continuously report the state of the interior volume of the supercooler and the supercooled liquid stored in containers therein. For example, programmable temperature sensors are found in 21st century automobiles wherein the temperature sensor monitors the atmospheric temperature and displays the temperature on the dashboard of the car allowing the driver to know at any given moment what the temperature outside of the automobile is in Fahrenheit or Celsius degrees.

The phrase, "set point" is used herein to describe the range of temperatures below the freezing point of water (32 deg-F, (0° C.)) within which a liquid remains in the liquid phase before it changes to a solid. A set point is found between the temperature of minimum ice crystal generation of a liquid and the temperature of maximum ice crystal generation of a liquid.

The phrase "slush activation" refers to a user choice that can activate a nucleator built into a compartment having backlit light emitting diode (LED) lights and an ultrasonic transducer for creating slush in closed containers/bottles placed into the compartment.

Reference will now be made in detail to the embodiments of the present invention, examples of which are illustrated in the accompanying drawings. The embodiments are described below to explain the invention by referring to the figures containing numerical identifiers and components listed below.

NUMERICAL IDENTIFIER COMPONENT

10 Refrigeration unit
12 Interior volume of refrigeration unit
12*a* First interior volume of refrigeration unit
12*b* Second interior volume of refrigeration unit
12*c* Third interior volume of refrigeration unit
13 Walls of inner casing
13*a* Inner surface of wall adjacent to interior volume 12
13*b* Outer surface of wall adjacent to enclosure 14
14 Enclosure housing the refrigeration unit
15 Shelf, adjustable and modular
16 Temperature sensor to sense or store information on state of interior volume 12 and/or state of liquid stored in the interior volume 12
16*a* Temperature sensor in contact with evaporator coils
18 Temperature maintaining assembly evaporator coils
20 Precision temperature controller

21 User interface providing information to a user or controller

30 Circulating fan

65 Insulative layer surrounding inner casing 13

72 Container used to warn user to remove freezing item

100 User input to supercooler system via the controller

100*a*-100*d* Steps to maintain supercooled steady state in system with warning bottle

110*a*-110*f* Steps to interrupt nucleation and freezing of warning bottle

200*a*-200*d* Steps to maintain supercooling steady state in system without a warning bottle

210*a*-210*h* Steps to alert user to freezing event and location of freezing event in system without a warning bottle

220 heat lamps in a series under shelving supporting supercooled liquid in closed containers

250 Liquid Crystal Display (LCD) screen to display messages/alerts sent to a user or controller

255*a* An example of an alert/warning message to a user

255*b* An example of a location message to a user

275 Light turned on over a bottle exhibiting an exothermic reaction

280 Bottle containing supercooled liquid undergoing an exothermic reaction

300 Refrigerator with "French door" showing a compartment on the front door of the refrigerator

310 Control panel on front door of refrigerator

310*a*-310*d* Buttons for user to make selection of desired form of liquid

320 Slush Activation port for making a slush beverage

350 Supercooler compartment in the interior volume of a standard refrigerator

360 Regular refrigerator compartment above 34 degrees F.

370 Regular refrigerator freezer compartment

As shown in FIGS. 1, 1A-3, the invention includes a refrigeration unit 10 for cooling and controlling humidity within an interior volume 12. The interior volume 12 of refrigeration unit 10 is housed within enclosure 14, which defines the outer boundaries of unit 10. The system includes one or more interior volume temperature sensors 16 disposed within interior volume 12. Refrigeration unit 10 may further include one or more circulating fans 30 to circulate cool air or moisture within the interior volume 12. In this manner, controller 20 can actuate circulating fans 30 such that different areas of interior volume reach and are maintained at precise (although potentially) different temperatures and humidity levels. Controller 20 can work independently from pre-programmed instructions or can receive input from user interface 21.

Variable-speed fans 30 produce the necessary airflow in a refrigerated space that is below approximately 32 deg-F (0° C.) to maintain the desired temperature throughout the interior volume 12. The use of sealed bearings may be advantageous in allowing the heat generating electrical motors to be placed on the exterior surface 13*b* of interior volume 12 while the fan blades spin inside the interior volume to provide necessary airflow.

Further, in FIGS. 1, 1A-3, the controller 20 utilizes one or more strategically placed temperature sensors 16 to detect variance from set temperature at multiple locations throughout the interior volume 12. The variance from set temperature and between individual sensors allows the temperature controller to turn on/off or vary the speed of the refrigeration compressor (not shown) and fans 30—collectively or individually—to attain and maintain the set temperature uniformly throughout the interior volume.

Interior volume 12 is generally defined by a plurality of inner surfaces which comprise inner casing 13. The walls of inner casing 13 comprise inner surfaces 13*a* (which are adjacent interior volume 12) and outer surfaces 13*b* which are adjacent enclosure 14.

The supercooling apparatus 10 includes a plurality of temperature sensors 16 for sensing a state of interior volume 12 or a state of a liquid stored in a container 72 (for example, temperature, release of a supercooled state, etc.), a user interface 21 for displaying an operation state of the supercooling apparatus 10, and for enabling the user to input a degree of cooling (setting of a supercooling temperature of the contents, setting of a cooling temperature, etc.), information on the liquid and the like, a controller 20 for storing a state of the interior volume 12 or the liquid, a degree of cooling, information on the liquid, etc., and maintaining the liquid in the supercooled state using the supercooling phenomenon, and a temperature maintaining assembly 18 for controlling the temperature of the interior volume 12 and the liquid. Although a power supply unit (not shown) to apply power to the above-described components is omitted, the configuration of the power supply unit is easily understood by a person of ordinary skill in the art to which the present invention pertains.

In detail, the temperature sensors 16 sense or store the state of the interior volume 12 and/or the state of the liquid stored in the interior volume 12, and the like, and informs the controller 20 of the sensing result. For example, the temperature sensors 16 can be a means for storing information on the volume of the interior volume 12 which is a state of the interior volume 12. A thermometer for sensing the temperature of the interior volume or the liquid, or a hardness meter, scale, optical sensor (or laser sensor) or pressure sensor for judging whether the liquid or the like has been stored in the interior volume 12 and whether the supercooling of the liquid is released, or the type, volume, and mass of the liquid or the like.

The user interface 21 can basically display a freezing temperature, a refrigerating temperature and the service type of the dispenser, and additionally displays the current execution of the supercooling mode and a released state of the supercooling of the liquid (that is, a state in which the freezing of the liquid is being performed).

The user interface 21 enables the user to input execution and selection of the supercooling mode for the storing space or the contents and setting of a supercooling temperature of liquid or the like in a supercooled state, as well as temperature setting for general freezing and refrigerating control, and selection of a service type (soft drink, beer, etc.) of a dispenser. In addition, the user can input information on the liquid such as the kind of the liquid, the temperature of the maximum ice crystal generation zone of the liquid, the phase transition temperature of the liquid, the mass of the liquid, and the volume of the liquid, through the user interface 21. The user interface 21 can be a barcode reader or a radio frequency identification (RFID) chip for providing the information on the liquid to the controller 20. In addition, the user interface 21 is connected to the temperature maintaining assembly 18 (or connected through the controller 20) for enabling the user to acquire an operation input of the temperature maintaining assembly 18 so as to allow the temperature maintaining assembly 18 to operate.

Moreover, the interior volume 12 within the enclosure of the refrigeration system can be divided into multiple interior volumes, such as 12*a*, 12*b*, 12*c* shown in FIG. 1. Each individual interior volume 12*a*, 12*b*, 12*c* can be independently controlled with respect to the temperature of the maximum ice crystal generation zone of the liquid.

The interior volume 12 can define a single refrigeration space or can be equipped with removable thermal-shelves allowing for configuration with multiple interior compartments, each with its own independent precision temperature control capability.

The individual interior volumes 12*a*, 12*b*, 12*c* utilize precision temperature sensors 16 to measure temperatures in each compartment and/or temperatures directly within the item(s) placed inside the compartments. Accordingly, the temperature of individual items can be determined to allow for precision temperature control of the items throughout the supercooling and storage process.

FIG. 1 shows a refrigeration unit 10 for cooling and controlling humidity within a plurality of interior volumes (12*a*-12*c*). Adjustable and modular shelves 15 are used to define the plurality of interior volumes 12*a*-12*c*. Interior volumes of refrigeration unit 10 are housed within enclosure 14, which defines the outer boundaries of unit 10. The system includes a plurality of interior volume temperature sensors 16, each disposed within an individual interior volume 12*a*-12*c*. This arrangement allows refrigeration unit 10 to be configured with singular, dual or multiple interior volumes. Each interior volume can be set and maintained with a different temperature. Shelves 15 are preferably constructed of an insulative material to help maintain the temperature in each interior volume 12*a*-12*c*.

For example, referring again to FIG. 1, a first interior volume 12*a* can be set to a first temperature setting (e.g. approximately 15 degrees F. (−9.4° C.)) for storing and maintaining a first type of liquid (e.g. beer) in a supercooled state. A second interior volume 12*b* can be set to second temperature setting (approximately 22 degrees F. (−5.5° C.)) which allows for sugared beverages to be stored in a super-cooled state to provide a thicker consistency (i.e. slush-on-demand drinks) than that allowed by most refrigerators. All of the above mentioned temperatures and uses are things that traditional refrigerators, freezers or combinations thereof do not do, or do not do well.

Temperatures for each interior volume are achieved through the use of independently controlled circulating fans 30 (either as a singular space or divided into separate compartments). The movement of air within the interior volume provides temperature regulation, rapid cooling, and air-flow patterns for uniform or isolated temperature distributions throughout a given interior volume.

The controller 20 is capable of precise temperature measurement and control. Such controllers are known in the art and illustrative controllers are manufactured by Johnson Controls®, Control Products® and others. In addition, the controller has the added capability of individually controlling temperatures in the multiple compartment configurations and optionally monitoring ambient temperature and compressor temperature to assist in adjusting compressor cycling, cooling times and patterns. The user interface 21 includes a touch pad with digital display and/or touch-screen with a variety of information on set temperatures, actual temperatures, and temperatures vs. time over periods of hours or days. Additionally, specific-use 'quick settings' (e.g. "beer" or "soda") are also provided for ease of use.

Figure 3:
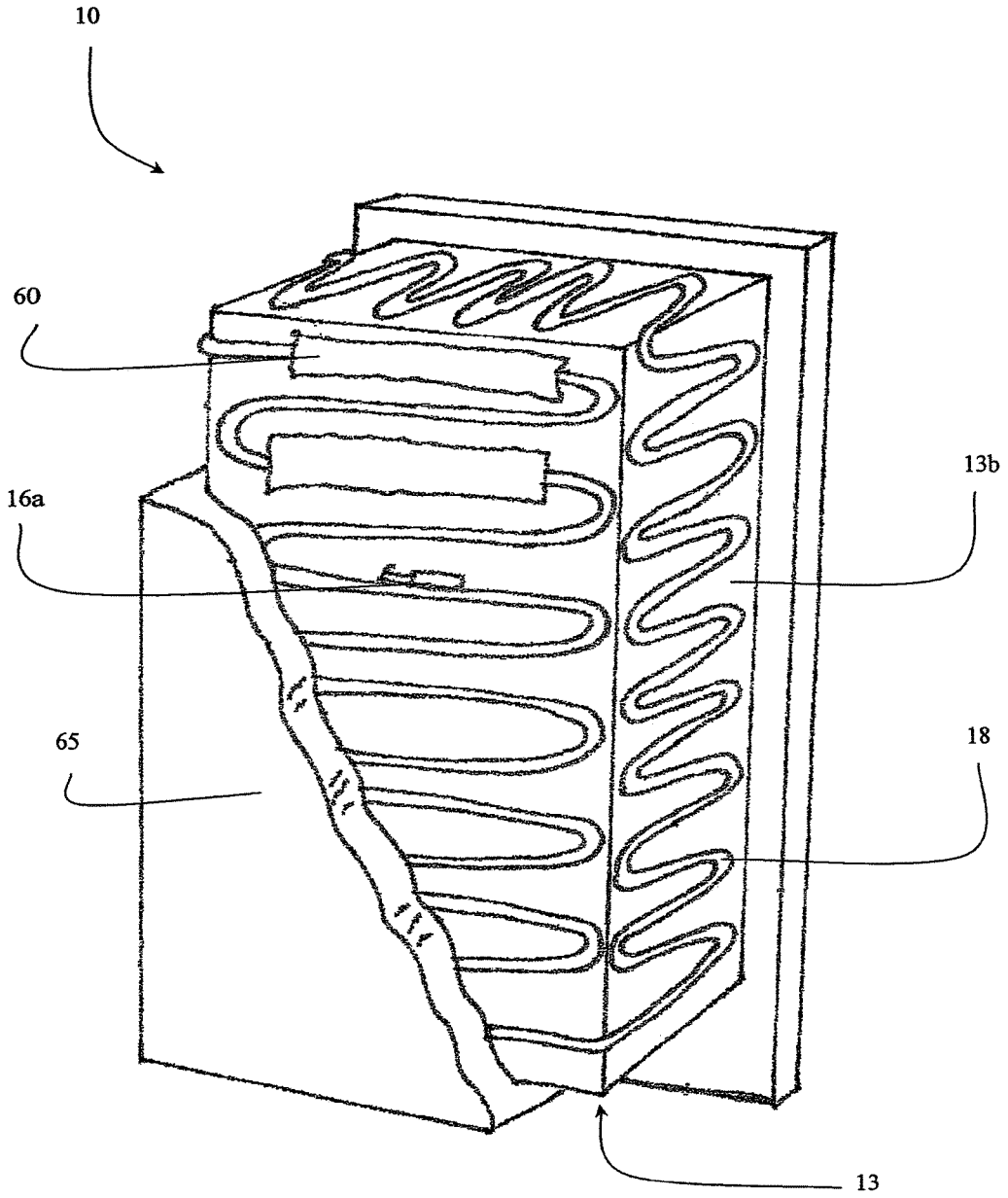
FIG. 3 is a partially exploded rear view of the illustrative supercooling system.

As shown in FIGS. 2 and 3, the temperature maintaining assembly 18 may be a thermally conductive piping or a metal plate having high conductivity (such as copper piping or aluminum plate).

The temperature maintaining assembly 18 is coupled to a refrigerant pipe of the evaporator (common to all refrigeration units, not shown). In this embodiment, a temperature maintaining assembly 18 is affixed to the exterior surface 13*b* and substantially surrounds inner casing 13. To maximize a contact area between the temperature maintaining assembly 18 and inner casing 13, a groove in which the temperature maintaining assembly 18 is seated may be defined in the exterior surface 13*b* of the inner casing 13. The temperature maintaining assembly 18 can be affixed to inner casing 13 via a thermally conductive tape or adhesive. Alternatively, the temperature maintaining assembly 18 may pass through a side surface of the inner casing 13. An additional sensor 16*a* is placed in thermal contact with the temperature maintaining assembly 18 to sense the state thereof and feed additional information to the controller 20.

One or more electronic temperature sensor 16*a* placed outside of the refrigerated cavity, directly adjacent to the evaporator coils of the temperature maintaining assembly 18 provide temperature readings of the cooling mechanism itself, rather than the interior volume 12. This additional temperature reading of the evaporator coils of the temperature maintaining assembly 18 can be used in a precision temperature control algorithm which varies compressor speed and/or an electronic expansion valve(s) opening to prevent the cooling coils from getting "too cold". This is especially important when supercooling beverages as they are sensitive to temperatures even a few degrees below the set point, which can cause them to nucleate inadvertently and begin to freeze. The controller 20 can provide maximum compressor power for rapid heat transfer during chill-down and energy efficient cooling during set temperature maintenance cycles while simultaneously limiting the low-side temperature of the evaporator cooling.

In a preferred embodiment, a layer of thermally insulative foam 65 surrounds inner casing 13 with the temperature maintaining assembly 18 disposed there between. Insulative layer 65 likewise resides between inner casing 13 and enclosure 14.

The temperature maintaining assembly 18 is a means for controlling the temperature within the interior volume 12 so as to prevent ice crystals from being generated within the liquid by maintaining the temperature of the interior volume 12 lower than the temperature of the maximum ice crystal generation of the liquid, more preferably, lower than the phase transition temperature of the liquid. The temperature maintaining assembly 18 may use a thermostatic material for maintaining the supercooling operation of the liquid in the container at a constant temperature higher than the temperature of the maximum ice crystal generation of the liquid or higher than the phase transition temperature of the liquid. Examples of this thermostatic material include a filling material, an antifreeze solution and the like.

The temperature maintaining assembly 18 covers substantially the exterior surface 13*b* of inner casing 13. The presence of the temperature maintaining assembly 18 immediately adjacent to the outer exterior surface 13*b* of inner casing 13 provides an efficient and uniform distribution of cooling throughout the interior volume 12. Optional features in this embodiment include thermally conductive tape, metal or other thermally conductive materials structures attached directly to the temperature maintaining exterior surface 13*b* of inner casing 13 to assist with efficient and uniform distribution of cooling to the surface areas of the interior volume 12.

The controller 20 controls the supercooling operation according to the present invention. The controller 20 executes the cooling of the interior volume 12 by controlling the temperature maintaining assembly 18. In the general supercooling mode, the cooling temperature is maintained, for example, at approximately 15° F. (−9.5° C.) to approximately 22° F. (−5.5° C.), or maintained below a temperature of the maximum ice crystal generation zone of the liquid. The controller 20 can control the temperature of the contents in the supercooled state by varying the cooling temperature in the interior volume 12 by executing user's setting of the cooling temperature by the user interface 21 or by executing setting of the cooling temperature according to information on the liquid.

In addition, the controller 20 acquires information on the liquid from the temperature sensors 16 or the user interface 21, and judges a cooling temperature and temperature of the maximum ice crystal generation zone of the liquid corresponding to the acquired information, thereby executing the corresponding cooling operation. For example, when the type of the liquid is determined, the corresponding temperature of the maximum ice crystal generation zone can be acquired; or, the temperature of the maximum ice crystal generation zone of the liquid can be stored in the storage user interface 21.

As the liquid in the container to be stored in the interior volume 12 is cooled, the temperature of the interior volume 12 is sensed by the temperature sensors 16, 16*a*, and the controller 20 initiates a temperature maintenance operation for maintaining the temperature of the interior volume 12 at a point lower than the temperature of the maximum ice crystal generation zone of the liquid by operating the temperature maintaining assembly 18. If the temperature of the liquid in the container is dropped below the temperature of the maximum ice crystal generation zone of the liquid, the possibility of freezing nuclei on the surface of the liquid in the container abruptly increases. Thus, it is preferable to operate the temperature maintaining assembly 18 before the drop occurs. More preferably, the temperature maintaining assembly 18 is operated to increase the temperature of the liquid in the container above the phase transition temperature of the liquid to remarkably reduce the possibility of freezing nuclei formation.

Table I below provides set point temperature ranges for a variety of supercooled bottled or canned beverages.

TABLE I

Set Point Fahrenheit Temperature Ranges

| BEVERAGE TYPE | BROAD RANGE* | NARROW RANGE* | PREFERRED RANGE* |
|---|---|---|---|
| Sugared Beverage | 15-25 | 18-22 | 20 |
| Alcoholic Beverage | 15-25 | 18-20 | 19 |
| Non-sugar Beverage | 22-31.5 | 25-30 | 28 |
| Fruit juice and Dairy | 18-27 | 20-25 | 23 |

*The above can be approximately before each of the units listed.

In one embodiment of the present invention, the container 72 in FIG. 1 produces heat energy at near 32 deg-F (0° C.) as a result of the exothermic nucleation reaction, which can be detected by one or more of the temperature sensors 16 programmed to send an alert to a user interface in order to warn a user to remove the freezing item before it becomes frozen hard and potentially ruptures.

Figure 4:
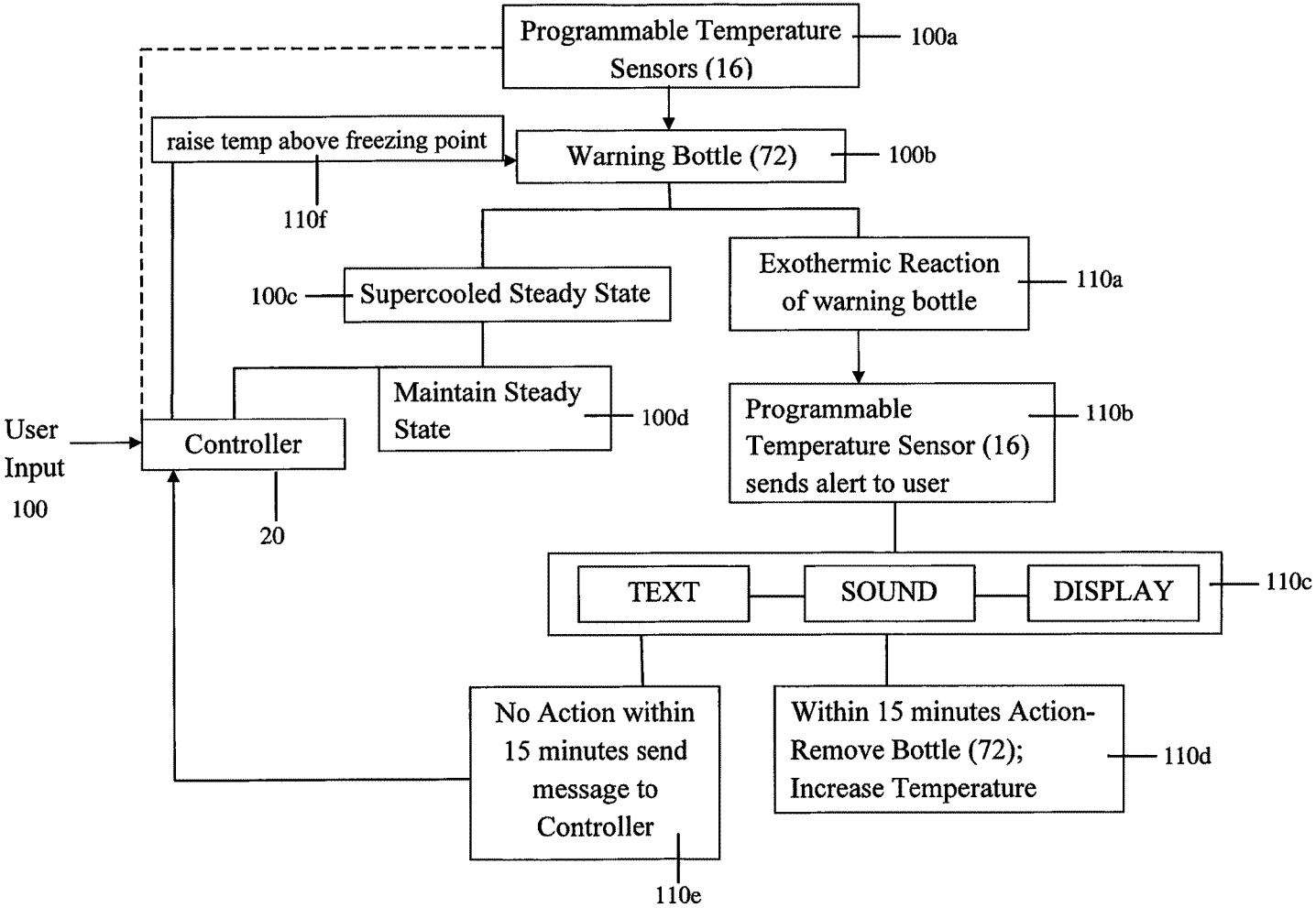
FIG. 4 is a flow chart that shows the general steps (100-100*d*) of a method, system or device for maintaining a supercooled steady state in a supercooler unit with a warning bottle for alerting a user that a liquid in the warning bottle is beginning to freeze or develop nucleation sites while stored in the supercooling system containing a plurality of bottles or closed containers. The general steps (110*a*-110*f*) describe a method, system or device for alerting a user when liquid in a warning bottle is beginning to freeze or develop nucleation sites while stored in a supercooling system containing a plurality of bottles or closed containers.

FIG. 4 shows the steps for maintaining a supercooled steady state in a supercooler unit with a warning bottle. User input 100 to the controller 20 gives parameters for supercooling a specific liquid in closed containers. The warning bottle is a closed container 72 filled with water or a water/glycol mixture with a specified set point representative of the liquid content of closed containers, such as, bottles and cans stored in the supercooler.

Algorithm(s) provide maximum compressor power for rapid heat transfer during chill-down and energy efficient cooling during set point temperature maintenance cycles while simultaneously limiting the low-side temperature of the evaporator cooling mechanism.

One or more programmable temperature sensors 16 located in the refrigerated space continually measure and compare temperatures 100*b* of the closed container 72 over time during compressor cycling. As long as the system maintains a steady state 100*c*, no action is required and the controller maintains the steady state 100*d*.

In FIG. 4, when the closed container 72 exhibits an exothermic (heat-creating) reaction 110*a* that indicates nucleation and subsequent freezing is in progress. The process can last for several tens of minutes or up to two and one-half hours, and is detected by a programmable temperature sensor located in close proximity to container 72. The programmable temperature sensor 16 sends a user alert or warning via text, sound or display 110*c* to allow removal and thawing of the freezing liquid in closed container 72 before the container freezes hard and/or ruptures. There is no need for a function to locate the container in this embodiment. The user takes corrective action if the supercooler is accessible. The corrective action can include, and is not limited to, giving instructions to the controller to warm the entire chamber above freezing, using spot heat sources or lights to warm or thaw individual bottles in the freezing process, or manually removing bottles identified in the freezing process and giving instructions to the controller to reset the operation of the supercooler and maintain a supercooled steady state.

Table II provides guidelines for user response time after receiving a warning from the temperature sensor that a process of nucleation and subsequent freezing to a solid phase is taking place in a supercooled environment.

TABLE II

Minutes to Respond to Alert

| BROAD RANGE* | NARROW RANGE* | PREFERRED RANGE* |
|---|---|---|
| 1-30 minutes | 10-20 minutes | 15 minutes |

It has been determined that the supercooled liquid nucleation and transition to a solid phase in a supercooled environment occurs slowly; however, prior to this invention, it was not known how to alert a user to this occurrence at an early stage so that action can be taken to prevent the item from becoming frozen hard and rupturing the container.

In FIG. 4, the user is given approximately 15 minutes to take action in response to the alert from the temperature sensor 110*d*. If the user does not address the warning within a preferred span of fifteen minutes from the time the alert is issued, a default, back-up electronic mechanism in the temperature sensor sends a message to the controller 110*e* to activate the compressor to cycle on and off to gradually increase the temperature in the supercooler above the freezing temperature of the liquid stored in the supercooler 110*f*; the temperature increase can be in a range of approximately 10 to approximately 20 degrees.

A means for increasing the temperature in response to an alert includes, but is not limited to, an electronic mechanism that activates the compressor to cycle on and off to gradually increase the temperature in the supercooler; an electronic mechanism that turns off the compressor, a defrost mechanism, a standby heat element, a spotlight or beam, a small heat lamp under each bottle to warm up a particular bottle and not affect other bottles.

The controller 20 allows the liquid to maintain a stable supercooled state by maintaining the cooling temperature of the interior volume 12 below the temperature of the maximum ice crystal generation zone of the liquid and maintaining the temperature of the liquid higher than the temperature of the maximum ice crystal generation zone of the liquid.

The controller 20 can maintain the supercooled state of the contents, such as the liquid or the like, by controlling the temperature maintaining assembly 18, and can increase or decrease the temperature of the contents, such as the liquid or the like, in the supercooled state by controlling a degree of cooling.

In addition, during the maintenance of the supercooled state of the liquid, the supercooled state of the liquid may be released due to the exertion of energy on the liquid (e.g. a shock), and thus a freezing process may occur in the container. In the event of such a freezing of the liquid, the controller 20 activates the operation of the temperature maintaining assembly 18 to maintain the temperature of the liquid above the phase transition temperature of the liquid, thereby thawing the frozen liquid.

Because freezing is an exothermic reaction, the freezing of the liquid can be judged, for example, by a change such as an increase in the interior volume 12 temperature sensed by the temperature sensor 16 (for example, in case that water maintained at −5° C. undergoes an abrupt temperature change from −5° C. to 0° C.). Alternatively, the temperature sensors 16 can be arranged and calibrated to directly detect the temperature of the liquid in the container and any corresponding changes.

In addition, the controller 20 may execute thawing by simultaneously or selectively controlling the temperature maintaining assembly 18. Such freeze-thaw cycles experienced by stored liquids results in temperature abuse and can be harmful to the quality and taste of the stored liquids; thus freeze-thaw cycles are preferably avoided. The present invention provides a method to interrupt the freezing process or transition of a liquid to the solid phase at an early time in the freezing process.

Figure 5:
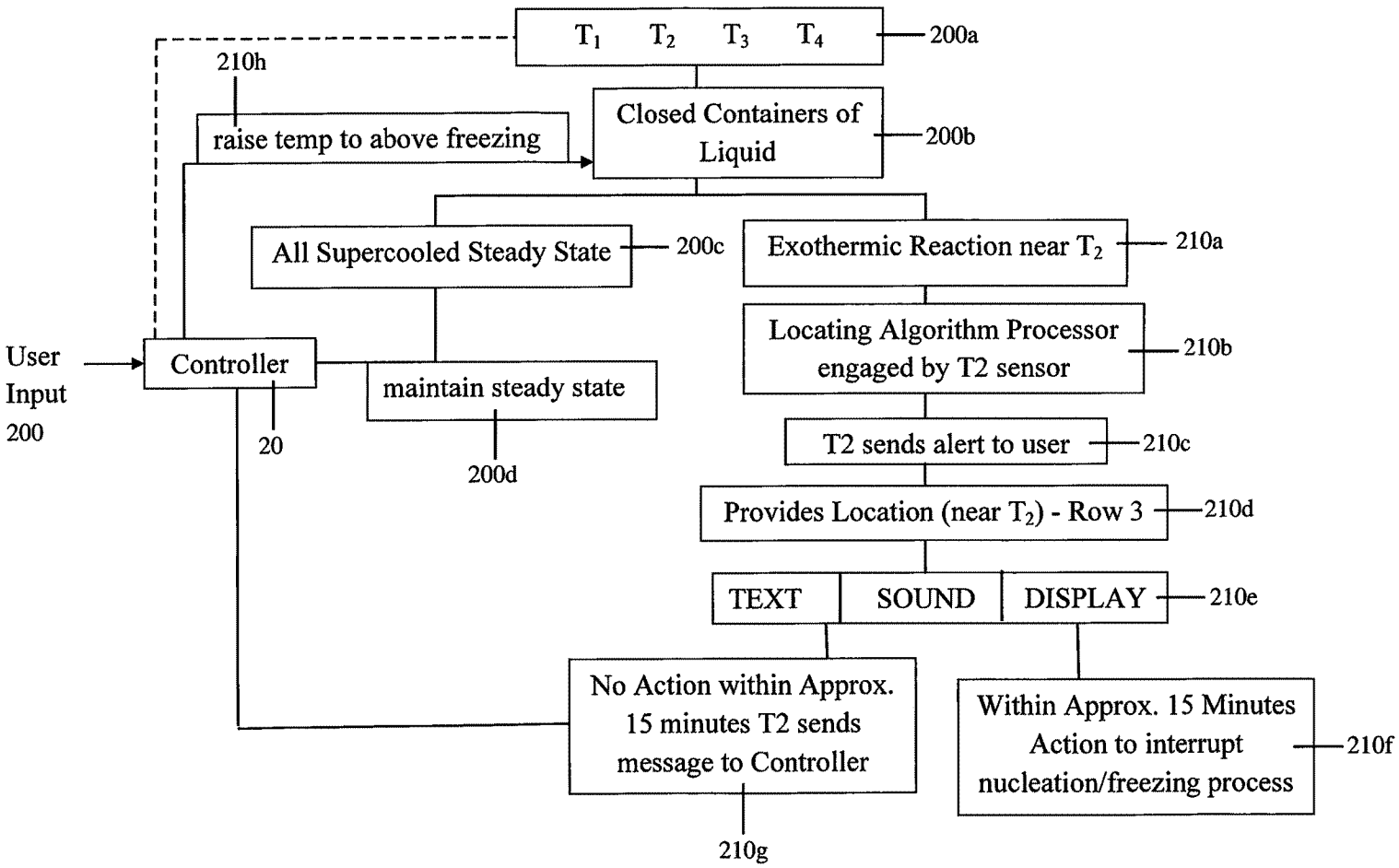
FIG. 5 is a flow chart that shows the general steps (200*a*-200*d*) of a method, system or device for maintaining a supercooled steady state in a supercooler unit without a warning bottle for alerting a user and providing a location of a bottle or closed container that is beginning to freeze or develop nucleation sites while stored in the supercooling system containing a plurality of bottles or closed containers. The general steps (210*a*-210*h*) alert a user to an inadvertent nucleation or freezing event and provide the location of the nucleation or freezing event in the supercooler system.

FIG. 5 shows how the present invention operates without a warning bottle to provide a warning and a means for locating a closed container that exhibits an exothermic (heat-creating) reaction that indicates nucleation and subsequent freezing is in progress.

An electronic mechanism is employed to detect premature freezing of any beverage container contained in the refrigerated space by electronically examining and computationally comparing temperature increases or decreases as the compressor is varied and/or cycled on and off. Nucleation and subsequent freezing of a bottled or canned beverage is an exothermic (heat creating) process lasting several tens of minutes, or up to approximately two hours, which takes place inside the refrigerated space and can be detected by one or more temperature sensors 16 located in the refrigerated space.

In FIG. 5, following user input 200 to the controller 20, a plurality of programmable temperature sensors such as ($T_1$, $T_2$, $T_3$, $T_4$) 200*a* are placed strategically on the top, bottom and side walls of the refrigerated space containing closed containers of liquid 200*b*. The temperature sensor that detects the exothermic freezing reaction 210*a* also identifies the location of the bottled or canned beverage that is beginning to freeze by the proximity of the bottle or canned beverage exhibiting an exothermic reaction to the temperature sensor. A locating algorithm processor compares temperatures of $T_1$, $T_2$, $T_3$, $T_4$ 210*b* to locate the bottle or canned beverage. Those skilled in the art appreciate that electronics capable of comparing temperatures over time during compressor cycling can be used to detect the time and location of a prematurely freezing can or bottle before it becomes hard-frozen, and a user alert can be given to allow removal and thawing of any freezing beverage before they freeze hard and/or rupture.

Further, in FIG. 5, programmable temperature sensor $T_2$ sends an alert to a user 210*c* and the location of the nucleation/freezing event is provided 210*d* by text, sound or display 210*e*. Thereafter, the user is allowed approximately 15 minutes to take action to interrupt the nucleation/freezing process 210*f*.

Then, similar to the embodiment shown in FIG. 4, if the user does not address the warning within a span of approximately 15 minutes from the time the alert is issued, a default, back-up electronic mechanism in the temperature sensor sends a message to the controller 210*g* to activate the compressor to cycle on and off to gradually increase the temperature in the supercooler to a temperature above the freezing temperature of the liquid stored in containers in the supercooler 210*h*.

Temperature sensors in FIG. 4 and FIG. 5 are programmed to provide an alert or warning when the temperature increases are detected in a broad range from approximately 0.1° F. to approximately 3° F., the narrow range of approximately 0.5° F. to approximately 1.5° F., and preferably after a temperature increase of approximately 1.0° F.

Accordingly, the inventive refrigeration unit 10 is able to maintain the temperature within the interior volume 12 within a predetermined range. Specifically, in a preferred embodiment, the temperature within the interior volume is maintained in a range from approximately 15 (fifteen) degrees F. (−9.5° C.) to approximately 22 (twenty-two) degrees F. (−5.5° C.). In all cases the invention is designed to keep the temperature within the interior volume 12 below the temperature of the maximum ice crystal generation zone of the liquid and maintain the temperature of the liquid higher than the temperature of the maximum ice crystal generation zone of the liquid.

Figure 6:
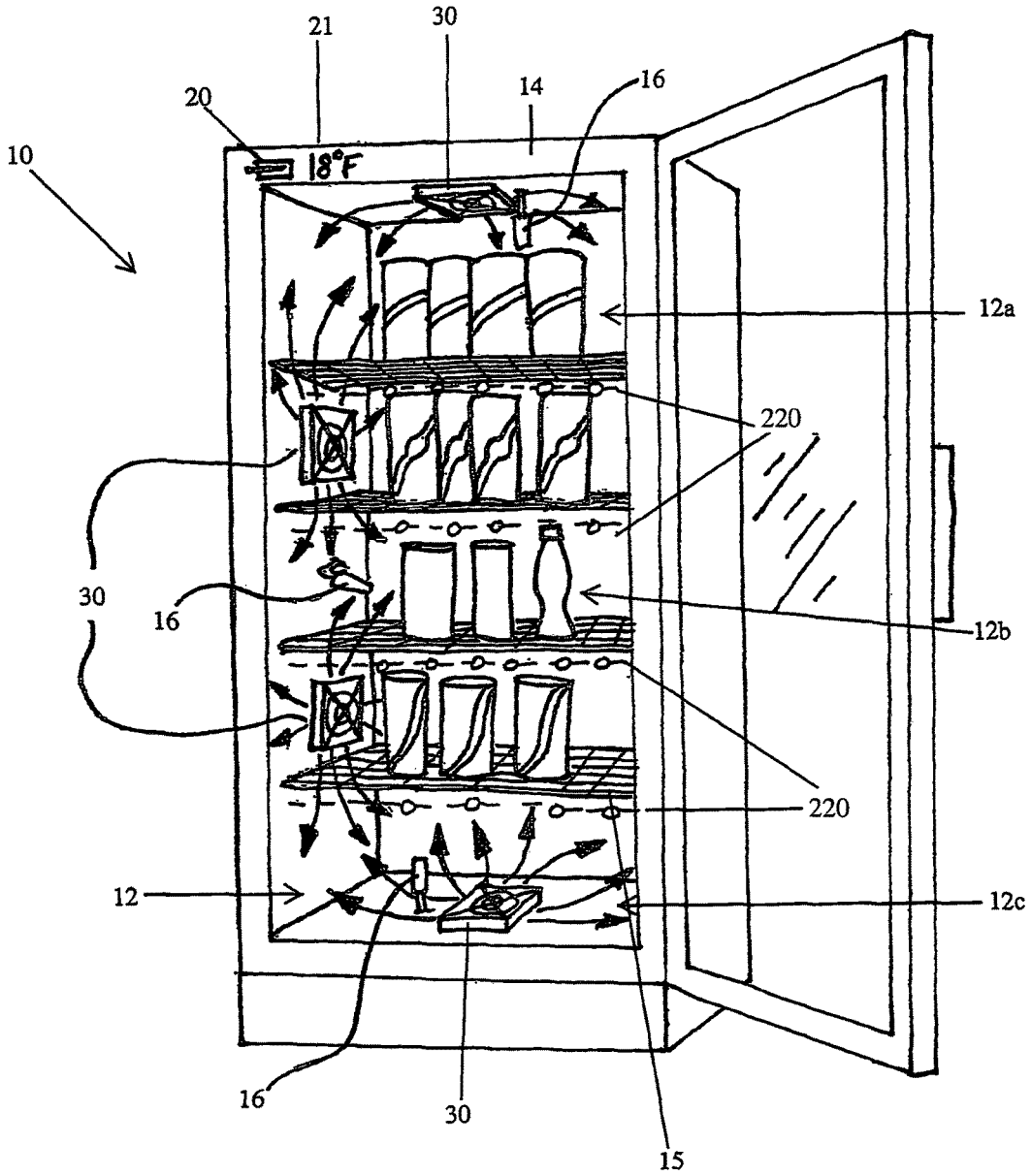
FIG. 6 shows a configuration of a series of heat lamps under shelving that supports closed containers of supercooled liquid in an embodiment of the present invention wherein at least one temperature sensor detects and locates the container that is beginning to freeze.

FIG. 6 shows a series of individual heat lamps 220 under shelving holding supercooled liquid in closed containers in an embodiment of the present invention wherein the programmable temperature sensor 16 detects and locates the closed container that is beginning to freeze. The series of heat lamps 220 is equipped with an LED light that is lit up when a lamp is activated to warm the bottle that has been identified as undergoing an exothermic reaction during freezing or transitioning to a solid phase. The LED light allows the user to locate and remove the bottle or take other action that interrupts the nucleation/freezing event.

Other means of increasing the temperature inside a supercooler unit to prevent nucleation and freezing of a supercooled liquid may include using separate heaters, cycling the compressor to heat the interior volume of the supercooling chamber or changing interior volume temperature settings.

Figure 7A:
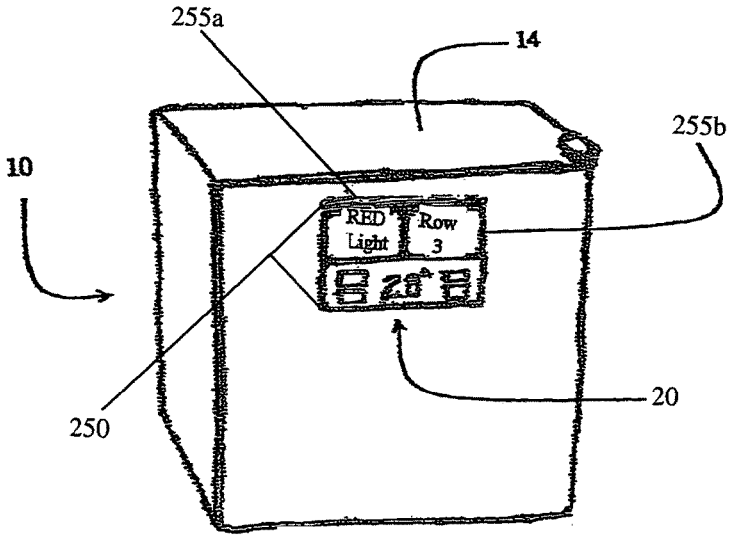
FIG. 7A shows a controller with a Liquid Crystal Display (LCD) screen on the front of a refrigerator door to display the alert/warning in the present invention exemplifying a visual alert on the left half of the screen and gives the location of a freezing container on the right half of the screen.

As shown in FIG. 7A, a controller includes a Liquid Crystal Display (LCD) screen 250 on the front door of the supercooler 10; an alert or warning from the programmable temperature sensor can be visual and viewed thereon. The warning is a red light 255*a* on the left half of the screen and on the right half of the screen an image showing the location

255*b* of the container exhibiting the exothermic freezing reaction. The alert or warning with location can be via text or email message identifying, for example, Row 3, upper left quadrant, bottom row. In addition, the alert or warning can be audible, as in a voice, an alarm sound, buzzing, beeps, or the like.

Figure 7B:
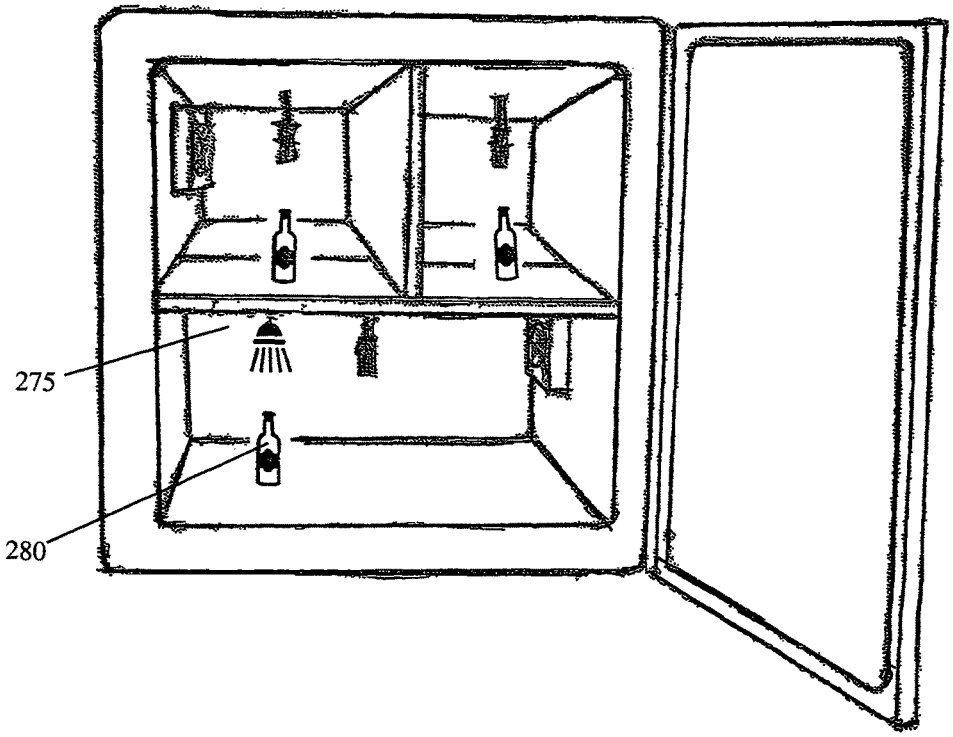
FIG. 7B shows the inside view of a refrigerator wherein the locator is a light over or under a bottle having an exothermic reaction wherein the heat released by the bottle activates or turns on the light.

FIG. 7B shows the inside view of a refrigerator wherein the locator is a light 275 over a bottle 280 having an exothermic reaction wherein the heat released by the bottle 280 causes the light to come on.

Figure 8A:
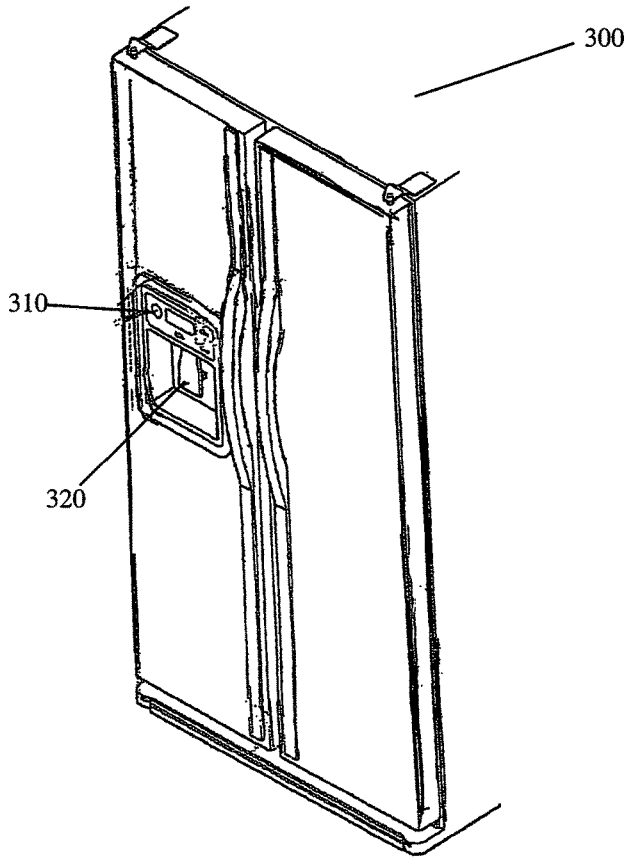
FIG. 8A shows a compartment on the front of a refrigerator door with a nucleator port and a control panel that includes buttons for a user to select ice water, ice cubes, crushed ice or slush activation.

FIG. 8A shows a refrigerator 300 with a first compartment on the front of the refrigerator door that includes a control panel 310 with buttons for a user to select ice water, ice cubes, crushed ice or slush activation and a nucleator port 320 for converting a supercooled liquid to a slush.

Figure 8B:
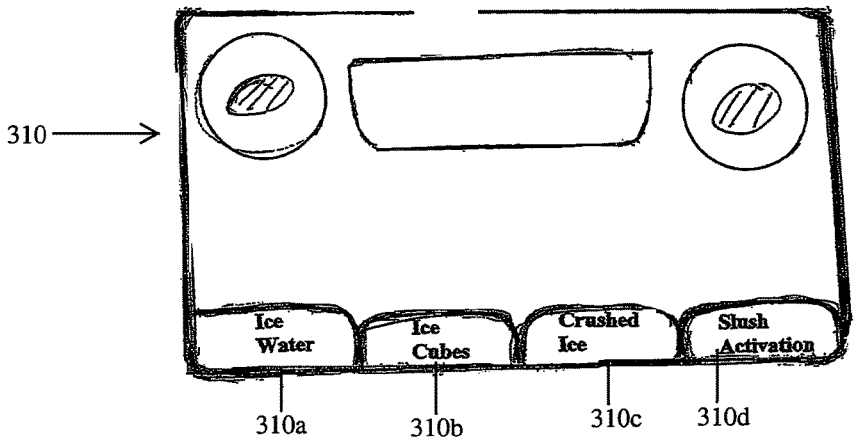
FIG. 8B is an enlarged view of the operable buttons for the control panel in FIG. 8A.

FIG. 8B shows an enlarged view of the control panel 310 on the first compartment on the front of the refrigerator door wherein the user can use switches, such as but not limited to switches, such as but not limited to buttons, and the like, to select ice water 310*a*, ice cubes 310*b*, crushed ice 310*c*, or slush activation 310*d*.

Figure 8C:
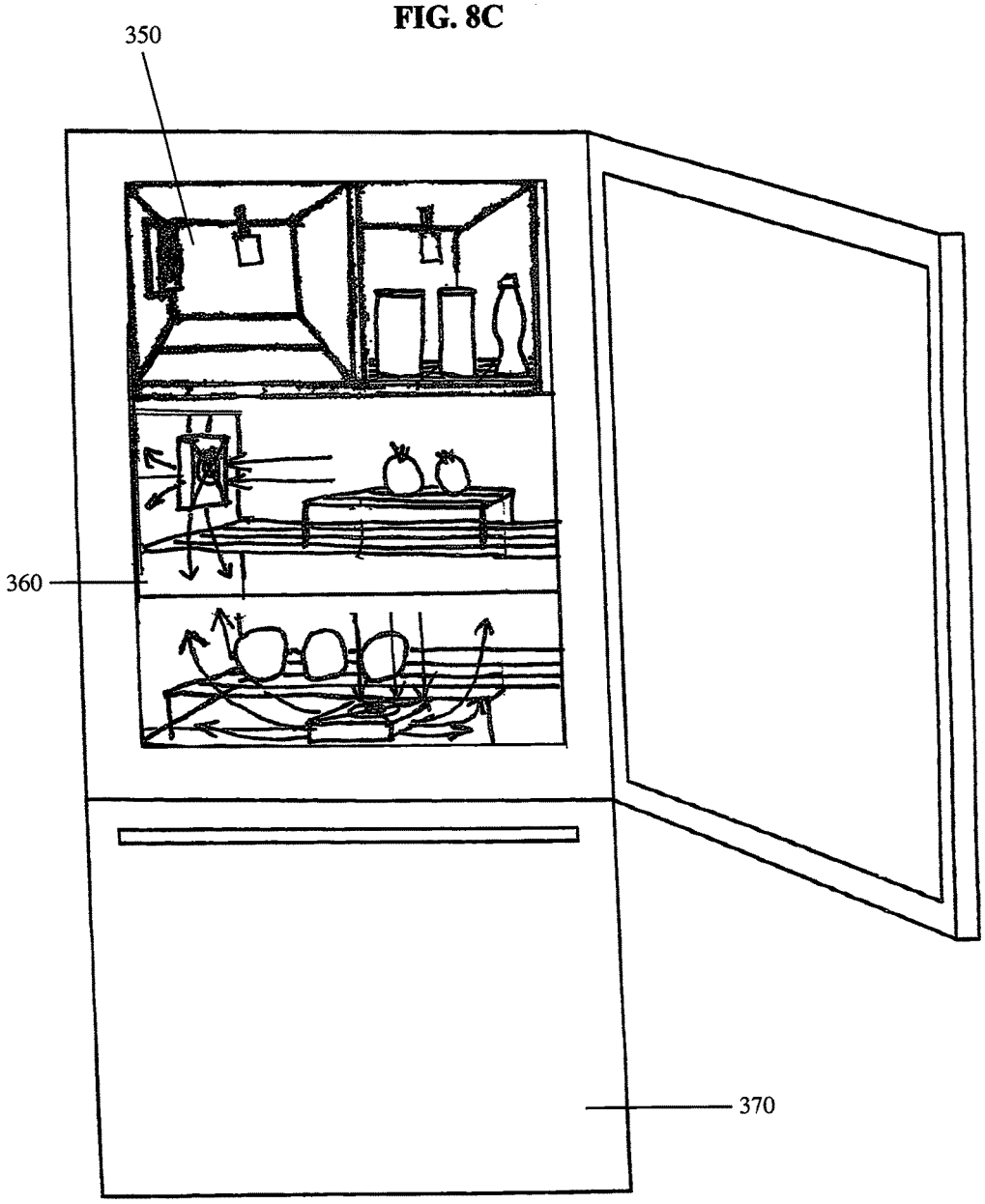
FIG. 8C is an inside view of a refrigerator with a first compartment on the front of the refrigerator door with a nucleator port and a control panel that includes buttons for a user to select ice water, ice cubes, crushed ice or slush activation and a second compartment in the interior volume of the refrigerator for supercooling and maintaining a closed container of liquid in a supercooled state.

FIG. 8C shows the inside of a refrigerator that includes a second compartment 350 in the interior volume of a refrigerator dedicated to the supercooling of liquid in closed containers with a variety of temperature settings, as disclosed in Table I. In addition, the refrigerator has a regular refrigerator compartment 360 for chilling foods and beverages at temperatures above approximately 34 degrees F. (1.1° C.), and a freezer compartment 370.

For example, a dedicated supercooling compartment 350 can be maintained in a temperature range between approximately 15° F. (−9.5° C.) to approximately 32° F. (0° C.) depending on the beverage that is maintained in the supercooled liquid state. Sugared beverages remain in a liquid phase at temperatures between approximately 27.0° F. to 29.0° F. Alcoholic beverages remain in a liquid phase at temperatures between approximately 25° F.-31° F.

Non-sugar beverages remain in a supercooled liquid phase at temperatures between approximately 22° F.-31.5° F. Fruit juice and dairy beverages remain in a supercooled liquid phase at temperatures between approximately 18° F.-27° F.

An example of the use of the precision supercooling refrigeration device of the present invention is illustrated in the combination of FIG. 8A, FIG. 8B and FIG. 8C. All features are understood to be combined in one appliance, i.e., the supercooler unit, the front door compartment with control panel and slush activation port. A user takes a supercooled closed beverage container directly from the supercooling compartment 350 in FIG. 8C, places the closed beverage container into the slush activation port 320 shown in FIG. 8A on the front door of the refrigerator 300 and when the user engages the slush activation button 310*d* shown in FIG. 8B; within approximately one second to approximately ten seconds, a cool, refreshing, delicious, slushy drink in a closed container is provided. The icy, slushy beverage can be one of water, a fruit drink, a fruit or vegetable juice, a carbonated soda, a beer, a daiquiri, mojito, or the like. The closed beverage container can be anyone of a bottle, can, or other closed container and the like.

The slush activation port 320 can incorporate the technology shown and described in U.S. patent application Ser. No. 14/731,850 to Shuntich, filed Jun. 5, 2015, which claims the benefit of priority to U.S. Provisional Patent Application No. 61/966,106 to Shuntich filed Feb. 18, 2014, both applications of which are incorporated by reference in their entirety. The slush activation 310*d* switch/button which when activated can generate an ultrasonic signal which causes a crystallization of the chilled liquid inside the beverage container in slush activation port 320.

Another embodiment can incorporate both a slush activation port 320 described above, as well a rapid spinning liquid immersion beverage cooling device, such as those described and shown in U.S. patent application Ser. No. 15/790,269 to Shuntich filed Oct. 23, 2017, which is a Continuation of U.S. patent application Ser. No. 14/298,117 to Shuntich filed Jun. 6, 2014, now U.S. Pat. No. 9,845,988, which claims the benefit of priority to U.S. Provisional Patent Application No. 61/966,106 to Shuntich filed Feb. 18, 2014. The entire disclosure of each of the applications listed in this paragraph are incorporated herein by specific reference thereto. In this embodiment, once the liquid inside the beverage container has been cooled to a supercooled temperature by the rapid spinning device, the liquid can then be activated into a slush as referenced above.

Further, a still another embodiment can substitute a rapid spinning liquid immersion beverage cooling device into port 320, such as those described and shown in U.S. patent application Ser. No. 15/790,269 to Shuntich filed Oct. 23, 2017, which is a Continuation of U.S. patent application Ser. No. 14/298,117 to Shuntich filed Jun. 6, 2014, now U.S. Pat. No. 9,845,988, which claims the benefit of priority to U.S. Provisional Patent Application No. 61/966,106 to Shuntich filed Feb. 18, 2014. The entire disclosure of each of the applications listed in this paragraph are incorporated herein by specific reference thereto. Here, the rapid spinning can be used to just chill liquid contents inside the beverage container to a desired chilled temperature as selected by the user.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense. Any materials, which may be cited above, are fully incorporated herein by reference.

It is also to be understood that the following claims are intended to cover all of the generic and specific features of the invention herein described, and all statements of the scope of the invention which, as a matter of language, might be said to fall there between. Relative terminology, such as "substantially" or "about," describe the specified materials, steps, parameters or ranges as well as those that do not materially affect the basic and novel characteristics of the claimed inventions as whole (as would be appreciated by one of ordinary skill in the art).

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A method for alerting a user that a liquid stored in a closed container in a supercooled state is beginning to nucleate and is in the process of freezing, comprising the steps of:

a. storing a designated warning container that produces a heat energy resulting from an exothermic nucleation reaction at approximately 32° F. (0° C.) when the liquid inside the container begins to freeze during storage in a supercooling apparatus, wherein the supercooling apparatus includes;

i. an interior volume of the supercooling apparatus with space for storing a liquid in a container;

ii. a plurality of fans attached to a plurality of side walls, a top wall and a bottom wall of the interior walls inside the supercooling apparatus;

iii. a temperature maintaining assembly comprising evaporator coils in thermal communication with the interior volume for cooling the interior volume below the freezing point of the liquid in the designated warning container; and iv. a plurality of temperature sensors disposed within the interior volume to sense a cooling temperature of at least one of a temperature within the interior volume, a temperature of the liquid in the plurality of containers, and a temperature of the one container that produces the heat energy at approximately 32° F. (0° C.) as a result of an exothermic nucleation reaction that occurs when freezing begins, wherein the temperature sensor detects a variance from a set temperature and sends a warning to a user;

b. programming at least one of the plurality of temperature sensors to detect the heat energy resulting from the exothermic nucleation reaction of the liquid inside the closed warning container that is beginning to freeze; and c. programming the at least one of the plurality of temperature sensors to provide a warning to a user to remove the designated warning container before the liquid inside the container becomes frozen hard and ruptures the designated warning container.

2. The method of claim 1, further including an electronic mechanism in the temperature sensor that sends a message to a controller to activate the compressor to cycle on and off to gradually increase the temperature in the supercooling apparatus to a temperature above the freezing temperature of the liquid stored in containers in the supercooling apparatus.

3. The method of claim 2, wherein the electronic mechanism in the temperature sensor is programmed to send a message to the controller in a time period of from approximately one second to approximately thirty minutes after a warning is sent to a user to remove the designated warning container.

4. The method of claim 3, wherein the electronic mechanism in the temperature sensor is programmed to send the message to the controller in a time period of approximately fifteen minutes after a warning is sent to a user to remove the designated warning container.

5. The method of claim 1, wherein the warning to the user includes at least one of an audible sound, a visual image, a lighted screen, or a text message to a smart phone.

6. The method of claim 1, wherein at least one of the plurality of temperature sensors is programmed to detect the heat energy resulting from the exothermic nucleation reaction of the designated warning container in a range between approximately 0.1° F. to approximately 3° F.

7. The method of claim 1, wherein at least one of the plurality of temperature sensors is programmed to detect the heat energy resulting from the exothermic nucleation reaction of the designated warning container in a range between approximately 0.5° F. to approximately 1.5° F.

8. The method of claim 7, wherein at least one of the plurality of temperature sensors is programmed to detect the heat energy resulting from the exothermic nucleation reaction when there is approximately 1° F. increase in temperature of the designated warning container.

9. The method of claim 1, further comprising:

a. a means for activating a default, back-up electronic mechanism to operate the temperature maintaining assembly and increase the temperature within the interior volume of the supercooling apparatus after a warning is sent to the user; and b. recording the warning to the user on a user interface.

10. A method for locating a supercooled liquid stored in a bottle or closed container that is beginning to nucleate and is in the process of freezing, comprising the steps of:

a. storing a plurality of closed containers containing supercooled liquid in a supercooling apparatus that includes, i. space within the interior volume for storing a liquid in a closed container;

ii. a plurality of temperature sensors for monitoring the temperature of at least one of the interior volume of the supercooling apparatus and the temperature of the liquid in the closed container stored therein, wherein at least one of the plurality of temperature sensors detects heat energy of an exothermic nucleation reaction that occurs when the liquid in the closed container begins to freeze and provides a location and a warning to remove the closed container holding the liquid before the liquid becomes frozen hard and ruptures the closed container;

iii. a user interface for displaying an operation state of the supercooling apparatus; and iv. a plurality of fans wherein at least one fan is attached to a side wall, at least one fan is attached to a back wall, at least one fan is attached to a top wall and at least one fan is attached to a bottom wall of the interior volume for the movement of air to provide temperature regulation, cooling, and air-flow patterns for temperature distribution throughout the interior volume;

b. programming the plurality of temperature sensors with an algorithm to compare temperatures of each of the plurality of temperature sensors and detect the heat energy resulting from the exothermic nucleation reaction of the closed container that is beginning to freeze; and c. providing a warning to a user to remove the closed container holding the liquid before the liquid becomes frozen hard and ruptures the closed container, wherein the warning to the user includes the location of the closed container with the exothermic nucleation reaction based on the proximity of the closed container releasing heat energy to at least one of the plurality of temperature sensors detecting the heat energy.

11. The method of claim 10, wherein the warning to the user includes at least one of an audible sound, a visual image, a lighted screen, or a text message.

12. The method of claim 10, wherein at least one of the plurality of temperature sensors is programmed to detect the heat energy resulting from the exothermic nucleation reaction of the closed warning container in a range between approximately 0.1° F. to approximately 3° F.

13. The method of claim 12, wherein the at least one of the plurality of temperature sensors is programmed to detect the heat energy resulting from the exothermic nucleation reaction of the closed warning container in a range between approximately 0.5° F. to approximately 1.5° F.

14. The method of claim 13, wherein the at least one of the plurality of temperature sensors is programmed to detect the heat energy resulting from the exothermic nucleation reaction when there is approximately 1° F. increase in temperature of the closed warning container.

15. The method of claim 10, further comprising:

a. a means for activating a default, back-up electronic mechanism to operate the temperature maintaining assembly and increase the temperature within the interior volume of the supercooling apparatus after a warning is sent to the user; and b. recording the warning to the user on a user interface.

16. A supercooling refrigeration device comprising:

a. a refrigerator with an interior volume containing a first compartment that houses a supercooler unit wherein the supercooler unit comprises i. an interior space for storing a supercooled liquid in a plurality of closed containers;

ii. a plurality of fans attached to a plurality of side walls, a top wall and a bottom wall of the interior walls inside the supercooler unit;

iii. a temperature maintaining assembly comprising evaporator coils in thermal communication with the interior volume and a controller for cooling the interior volume below the freezing point of the liquid in the plurality of closed containers; and iv. a plurality of programmable temperature sensors disposed within the interior space of the supercooler unit to sense a cooling temperature of at least one of a temperature within the interior volume, a temperature of the liquid in the plurality of closed containers, and a temperature of the one of the plurality of closed containers that produces a heat energy as a result of an exothermic nucleation reaction that occurs when freezing begins, wherein the temperature sensor detects a variance from a set temperature and provides a location and a warning to a user; and b. the refrigerator with a second compartment on the front door thereof containing a control panel and a nucleator port.

17. The supercooling refrigeration device of claim 16, wherein the control panel has buttons for a user to select at least one of ice water, ice cubes, crushed ice or slush activation.

18. The supercooling refrigeration device of claim 16, wherein the nucleator port includes a plurality of backlit light emitting diode (LED) lights and an ultrasonic transducer for creating slush in a closed container of supercooled liquid placed into the nucleator port.

19. The supercooling refrigeration device of claim 16, wherein the closed container of supercooled liquid is monitored continuously by the plurality of programmable temperature sensors that detect heat energy of the exothermic nucleation reaction that occurs when the liquid in the closed container begins to freeze and at least one of the plurality of temperature sensors provides a location and a warning to remove the container holding the liquid that is beginning to freeze before the liquid becomes frozen hard and ruptures the container.

20. The supercooling refrigeration device of claim 19, wherein the warning to the user includes at least one of an audible sound, a visual image, a lighted screen, or a text message.

* * * * *